US011813851B2

(12) United States Patent
Inoue

(10) Patent No.: US 11,813,851 B2
(45) Date of Patent: Nov. 14, 2023

(54) PRINTING APPARATUS AND METHOD FOR CONTROLLING PRINTING APPARATUS

(71) Applicant: SEIKO EPSON CORPORATION, Tokyo (JP)

(72) Inventor: Yuki Inoue, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 17/445,506

(22) Filed: Aug. 20, 2021

(65) Prior Publication Data

US 2022/0055384 A1 Feb. 24, 2022

(30) Foreign Application Priority Data

Aug. 24, 2020 (JP) ..... 2020-140705

(51) Int. Cl.
*B41J 11/42* (2006.01)

(52) U.S. Cl.
CPC ..... *B41J 11/42* (2013.01)

(58) Field of Classification Search
CPC ..... B41J 11/006; B41J 11/20; B41J 11/005; B41J 11/42; B41J 13/0027; B41J 13/0036; B41J 13/0009; B41J 13/025
See application file for complete search history.

(56) References Cited

U.S. PATENT DOCUMENTS 5,420,621 A * 5/1995 Richtsmeier ..... B41J 13/03 271/10.04
2004/0179062 A1* 9/2004 Rai ..... B41J 2/145 347/42
2016/0288539 A1 10/2016 Yanagisawa et al.

FOREIGN PATENT DOCUMENTS

DE 69725200 T2 * 8/2004
JP 2016-193561 A 11/2016

OTHER PUBLICATIONS

Sugiyama, Machine TranslationofDE-69725200-T2, 2004 (Year: 2004).*

* cited by examiner

*Primary Examiner* — Scott A Richmond
(74) *Attorney, Agent, or Firm* — WORKMAN NYDEGGER

(57) ABSTRACT

A printing apparatus includes: a printing head configured to discharge ink onto a recording medium to form an image; a platen including a support surface that supports the recording medium; and a recording medium holding portion being configured to hold a plurality of star wheels configured to hold the recording medium toward the support surface in a direction perpendicular to the support surface. In a case in which a maximum value of a height of the recording medium from the support surface in the direction perpendicular to the support surface is less than 2.2 mm when the recording medium passes between the support surface and the recording medium holding portion, a load of one of the star wheels for holding the recording medium with presence of the recording medium holding portion is equal to or less than 4.5 gf.

2 Claims, 9 Drawing Sheets

PRINTING APPARATUS AND METHOD FOR CONTROLLING PRINTING APPARATUS

The present application is based on, and claims priority from JP Application Serial Number 2020-140705, filed Aug. 24, 2020, the disclosure of which is hereby incorporated by reference herein in its entirety.

BACKGROUND

1. Technical Field

The present disclosure relates to a printing apparatus and a method for controlling the printing apparatus.

2. Related Art

In the related art, as indicated in JP-A-2016-193561, a printer has been known that includes a printing head configured to discharge ink, a platen unit including a platen surface that supports a medium, and a star wheel that holds the medium supported by the platen surface.

However, in the printer described above, there is a problem that, for example, when a label sheet and the like as a medium are held by the star wheel, image quality decreases due to a trace of a protrusion of the star wheel remaining on the label sheet, and adhesion of an adhesive of the label sheet to a tip portion of the protrusion of the star wheel and thus a transfer, to another place of the label sheet, of ink adhering to the adhesive.

SUMMARY

A printing apparatus includes a printing head configured to discharge ink onto a recording medium to form an image, a platen including a support surface that supports the recording medium, and a recording medium holding portion at a position that is located downstream of the printing head in a transport direction of the recording medium and faces the support surface, the recording medium holding portion being configured to hold a plurality of star wheels configured to hold the recording medium toward the support surface in a direction perpendicular to the support surface, where, in a case in which a maximum value of a height of the recording medium from the support surface in the direction perpendicular to the support surface is less than 2.2 mm when the recording medium passes between the support surface and the recording medium holding portion, a load of one of the star wheels for holding the recording medium is equal to or less than 4.5 gf. Note that the maximum value is a maximum value of a height of the recording medium from the support surface in the direction perpendicular to the support surface, the height being a height of the recording medium from the support surface provided that the recording medium holding portion is absent.

A method for controlling a printing apparatus is a method for controlling a printing apparatus including a printing head configured to discharge ink onto a recording medium to form an image, a platen including a support surface that supports the recording medium, a recording medium holding portion located at a position that is downstream of the printing head in a transport direction of the recording medium and faces the support surface, the recording medium holding portion being configured to hold a plurality of star wheels configured to hold the recording medium toward the support surface in a direction perpendicular to the support surface, a hoisting and lowering unit configured to hoist and lower the recording medium holding portion with respect to the support surface, and a designation unit configured to designate a permissible value of a height of the recording medium from the support surface in the direction perpendicular to the support surface when the recording medium passes between the support surface and the recording medium holding portion, and the method includes controlling the hoisting and lowering unit such that a force of one of the star wheels for holding the recording medium becomes equal to or less than 4.5 gf in a case in which a height of the recording medium from the support surface in the direction perpendicular to the support surface is equal to or less than the permissible value when the recording medium passes between the support surface and the recording medium holding portion. Note that the permissible value is a permissible value of a height of the recording medium from the support surface in the direction perpendicular to the support surface, the height being a height of the recording medium from the support surface provided that the recording medium holding portion is absent.

DESCRIPTION OF EXEMPLARY EMBODIMENTS

1. First Exemplary Embodiment

First, a configuration of a printing apparatus 10 will be described.

Figure 1:
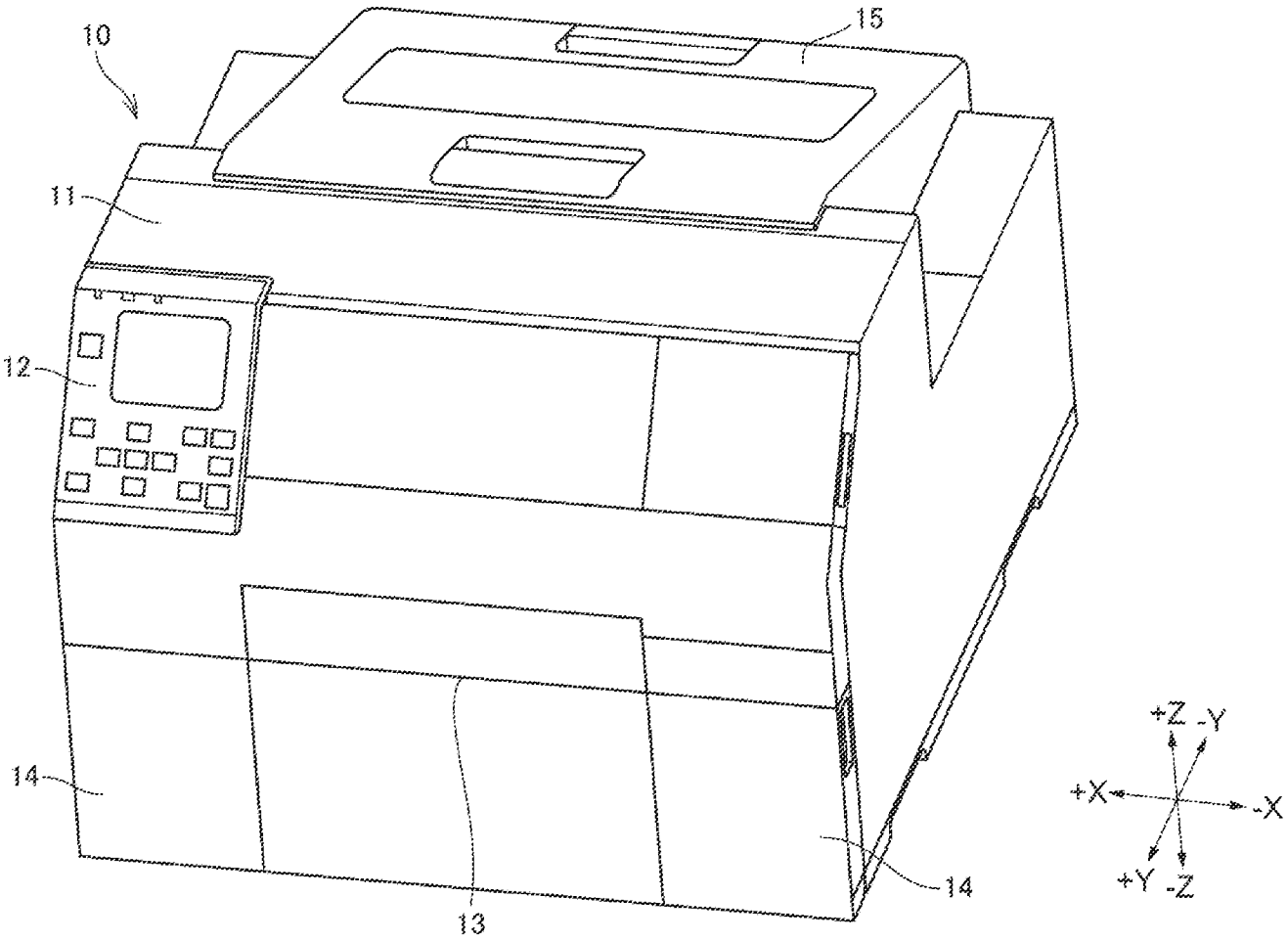
FIG. 1 is a perspective view illustrating an external configuration of a printing apparatus according to a first exemplary embodiment.
Figure 2:
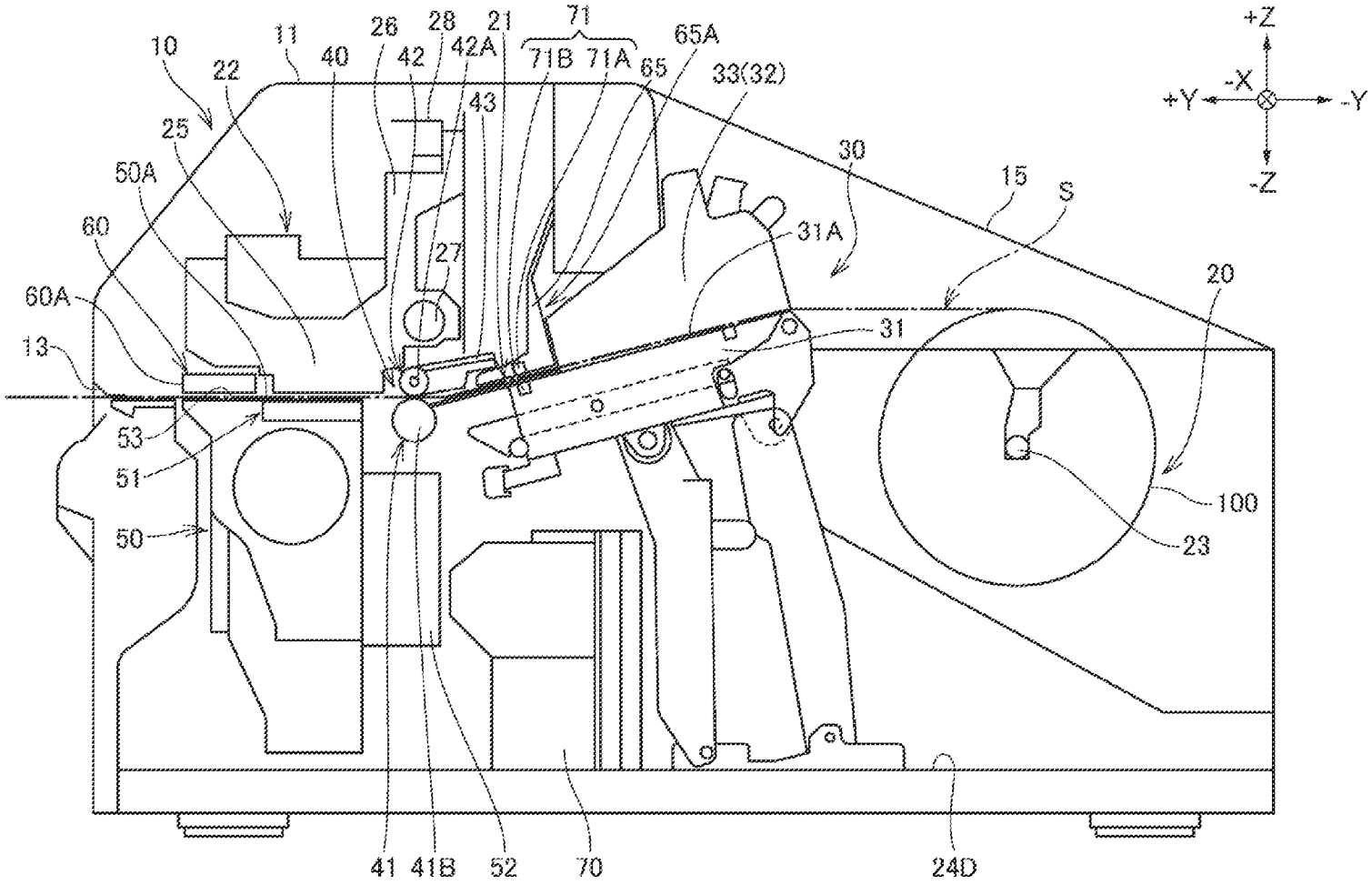
FIG. 2 is a schematic view illustrating an internal configuration of the printing apparatus according to the first exemplary embodiment.

FIG. 1 is a perspective view illustrating an external configuration of the printing apparatus 10, and FIG. 2 is a schematic view illustrating an internal structure of the printing apparatus 10.

The printing apparatus 10 is a printer that performs printing on a continuous sheet S such as a label sheet acquired by bonding a label to a long mount at a fixed interval, and is also referred to as a label printer. The continuous sheet S is an example of a recording medium. The printing apparatus 10 is coupled to an information processing terminal via a USB cable, a LAN, or the like in a wired or wireless manner, and performs printing based on print data transmitted from the information processing terminal. The USB is an abbreviation for universal serial bus. The LAN is an abbreviation for local area network.

As illustrated in FIG. 1, the printing apparatus 10 includes a case 11 constituting a housing of the printing apparatus 10. An operation panel 12 including an operation button and the like is provided on a +X direction side of a front surface in a +Y direction of the case 11. A paper exit 13 having a slit shape from which the continuous sheet S on which printing is performed is emitted is provided in a central portion of the front surface of the case 11. A mounting portion cover 14 that covers a mounting portion for mounting an ink cartridge is provided on both sides of the paper exit 13 along an X-axis. The mounting portion cover 14 is opened and closed when the ink cartridge is replaced.

A cover 15 is provided on an upper surface of the case 11 in a +Z direction. The cover 15 moves to an open position and is opened, and thus a guide unit 30 provided on a transport path 21 of the continuous sheet S is exposed. The cover 15 according to the present exemplary embodiment can rotate about a hinge (not illustrated) between the open position and a closed position.

As illustrated in FIG. 2, the printing apparatus 10 includes an accommodation portion 20 that accommodates roll paper 100 in which the continuous sheet S is wound in a roll shape, the transport path 21 from the accommodation portion 20 to the paper exit 13 of the case 11, and a printing unit 22 that performs printing on the continuous sheet S in a predetermined position of the transport path 21. In the present exemplary embodiment, a configuration using the roll paper 100 as the continuous sheet S will be described. Further, a direction in which the continuous sheet S is transported along the transport path 21 from the accommodation portion 20 toward the paper exit 13 will be described as a transport direction, and a direction orthogonal to the transport direction will be described as a width direction (a direction along the X-axis).

Note that the continuous sheet S is not limited to a label sheet, and various types are used. For example, a sheet folded along perforation provided at an interval in a longitudinal direction, which is so-called fanfold paper, may be used.

The accommodation portion 20 is disposed below the cover 15 of the case 11. The roll paper 100 is rotatably supported by a side wall portion of the accommodation portion 20 via a roll paper rotary shaft 23.

The guide unit 30 is disposed in the +Y direction of the accommodation portion 20. The guide unit 30 functions as a paper guide for the continuous sheet S. The guide unit 30 includes a guide table 31 that can support a lower surface of the continuous sheet S pulled out from the accommodation portion 20. The guide table 31 includes an upper surface plate 31A extending in the width direction and being inclined downward on a front side. A fixing guide 32 and a movable guide 33 that have a side wall shape and guide the continuous sheet S are supported by the guide table 31. The fixing guide 32 is fixed on a −X direction side of the upper surface plate 31A. The movable guide 33 is slidably supported in the width direction of the upper surface plate 31A, and is supported such that the movable guide 33 can be close to and away from the fixing guide 32.

The fixing guide 32 and the movable guide 33 extend in the transport direction of the continuous sheet S. The fixing guide 32 and the movable guide 33 guide a position of a side end of the continuous sheet S. The continuous sheet S is transported with a fixing guide 32 side as a reference of a position.

In the printing apparatus 10, when a position of the guide 32 and 33 is adjusted according to a paper width of the continuous sheet S, a position of the movable guide 33 is adjusted while the side end of the continuous sheet S is in contact with the fixing guide 32. Thus, the side end of the continuous sheet S that abuts the fixing guide 32 is always aligned in the same position in the width direction and is transported regardless of a paper width of the continuous sheet S.

Figure 3:
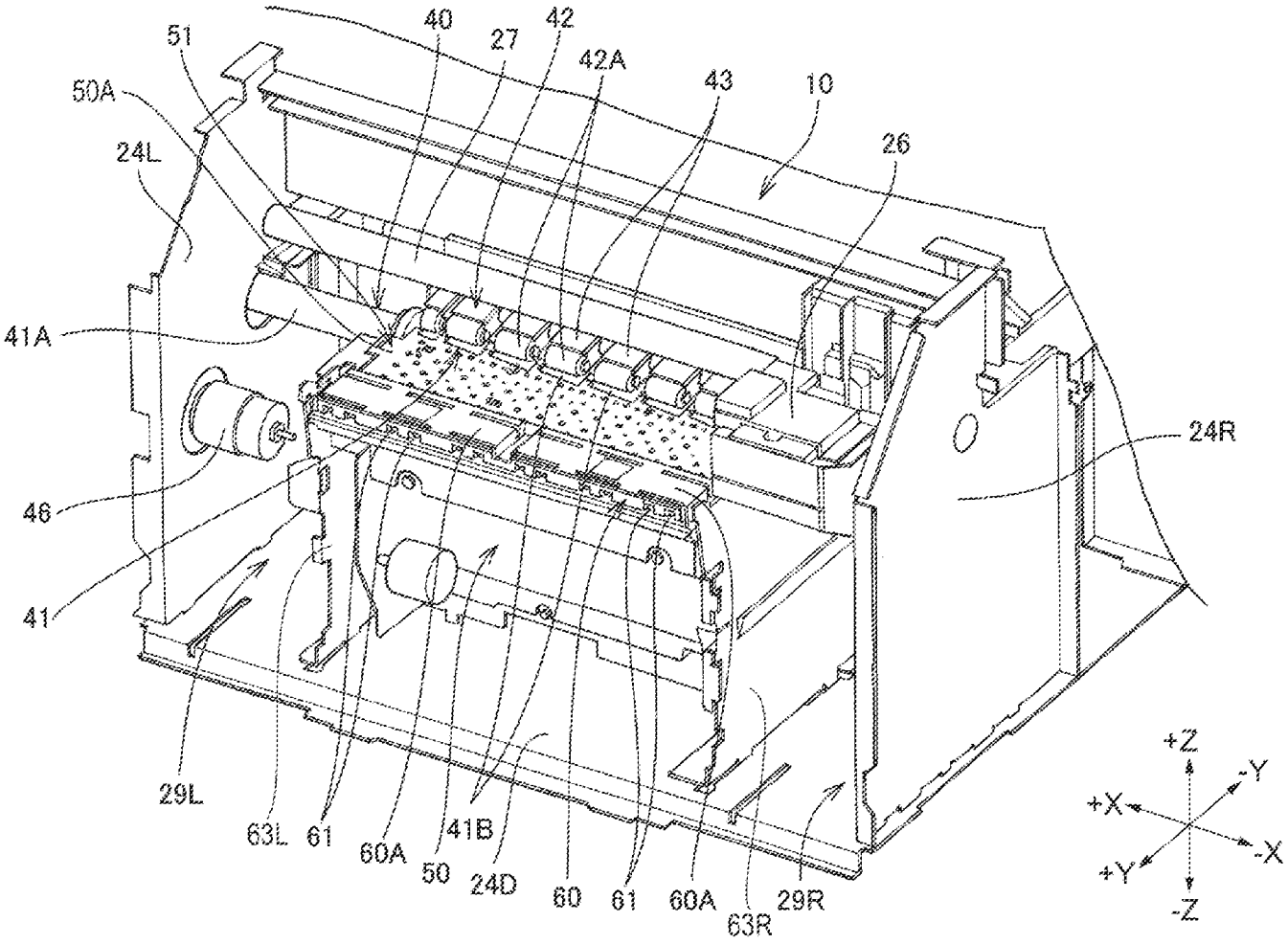
FIG. 3 is a partial perspective view illustrating the internal configuration of the printing apparatus according to the first exemplary embodiment.

FIG. 3 is a partial perspective view illustrating the internal structure of the printing apparatus 10.

The printing apparatus 10 includes a bottom frame 24D having a flat plate shape, and side frames 24L and 24R that have a side wall shape and provided upright on both side end portions in a direction along the X-axis of the bottom frame 24D. The bottom frame 24D and the side frames 24L and 24R are covered by the case 11.

A paper feeding roller 40 is supported by the side frames 24L and 24R. The paper feeding roller 40 is provided downstream of the guide unit 30 in the transport direction. The paper feeding roller 40 includes a driving roller 41, and a driven roller 42 facing the driving roller 41.

The driving roller 41 includes a shaft portion 41A extending in the width direction, and a roller portion 41B that is provided on the shaft portion 41A and has a diameter larger than that of the shaft portion 41A. The driving roller 41 is rotatably supported by the side frames 24L and 24R. The roller portion 41B is provided on the shaft portion 41A at an interval in a shaft direction.

The driven roller 42 is disposed above the driving roller 41. The driven roller 42 includes a roller body 42A. The roller body 42A is provided for each roller portion 41B of the driving roller 41, and is disposed so as to face the roller portion 41B. The roller body 42A is supported by an arm 43 extending along a Y-axis. The roller body 42A is rotatably supported, by an end portion of the arm 43 in the +Y direction, about the center of rotation extending in the width direction as the center. The arm 43 is rotatably supported, by the side frames 24L and 24R, about the center of rotation extending in the width direction at an end portion in a −Y direction. The arm 43 is biased by a biasing member (not illustrated), and is biased such that the roller body 42A is pressed against the driving roller 41. The continuous sheet S is sandwiched and transported between the driving roller 41 and the driven roller 42.

A transport motor 46 is supported by the side frame 24L on the +X direction side. The transport motor 46 transmits power to the driving roller 41 via a power transmission member (not illustrated). The transport motor 46 is configured such that the transport motor 46 can be normally and reversely driven, and causes the driving roller 41 to rotate normally and reversely. When the transport motor 46 is driven, the driving roller 41 is driven. Further, the driven roller 42 pressed against the driving roller 41 is driven by rotation with rotation of the driving roller 41.

As illustrated in FIG. 2, the printing unit 22 is disposed downstream of the paper feeding roller 40 in the transport direction. The printing unit 22 includes an inkjet head 25 (corresponding to a printing head) that discharges ink onto the continuous sheet S. The inkjet head 25 is mounted on a carriage 26. The carriage 26 is movably supported in the width direction along a carriage shaft 27 extending in the width direction. Further, the carriage 26 is movably supported along a guide frame 28 provided inside the case 11.

The carriage 26 moves along the carriage shaft 27 and the guide frame 28, and thus the inkjet head 25 is moved in a main scanning direction (a direction along the X-axis).

The inkjet head 25 includes a plurality of nozzle rows corresponding to ink of four colors of CYMK, for example. The inkjet head 25 receives a supply of ink from the ink cartridge (not illustrated), discharges ink from a nozzle provided in each of the nozzle rows, forms a dot on the continuous sheet S to form an image.

As illustrated in FIG. 3, ink cartridge mounting portions 29L and 29R are provided in the +X direction and the −X direction of a body of the printing apparatus 10. A pressure pump unit 70 illustrated in FIG. 2 is coupled to the ink cartridge mounted on the ink cartridge mounting portions 29L and 29R via a tube (not illustrated). The pressure pump unit 70 is driven to apply pressure to the ink cartridge, and thus ink is supplied to the inkjet head 25 through an ink flow path (not illustrated).

Here, the number of colors of ink used by the printing apparatus 10 is not limited to four colors. For example, the printing apparatus 10 may be configured to perform printing with ink of multiple colors acquired by adding ink of a specific color to four colors of CMYK. Further, the printing apparatus 10 may be configured to perform monochrome printing or printing with ink of two colors.

A platen 50 is disposed in a position facing the inkjet head 25 in the transport path 21. The platen 50 includes a flat support surface 50A on which the continuous sheet S is supported. The platen 50 includes a suction platen 51 in a position facing the inkjet head 25. The suction platen 51 extends to a range in which a dot can be formed by the inkjet head 25. The suction platen 51 has a plurality of suction holes, and the suction hole communicates with a suction fan 52. The continuous sheet S placed on the support surface 50A corresponding to the suction platen 51 of the support surface 50A is sucked by the suction fan 52. The printing apparatus 10 can transport such that the continuous sheet S does not float from the suction platen 51 by transporting the continuous sheet S in a state where the suction platen 51 is operated, that is, in a state where the continuous sheet S is sucked. In this way, a distance between the continuous sheet S and the inkjet head 25 is appropriately maintained.

The support surface 50A downstream of the suction platen 51 in the transport direction is a non-suction surface 53 in which the suction hole is not formed. Thus, a star wheel unit 60 (corresponding to a recording medium holding portion) for suppressing floating of the continuous sheet S is disposed above the non-suction surface 53.

In other words, the star wheel unit 60 is located downstream of the inkjet head 25 in the transport direction, and is also located in a position facing the non-suction surface 53 of the support surface 50A.

Figure 4:
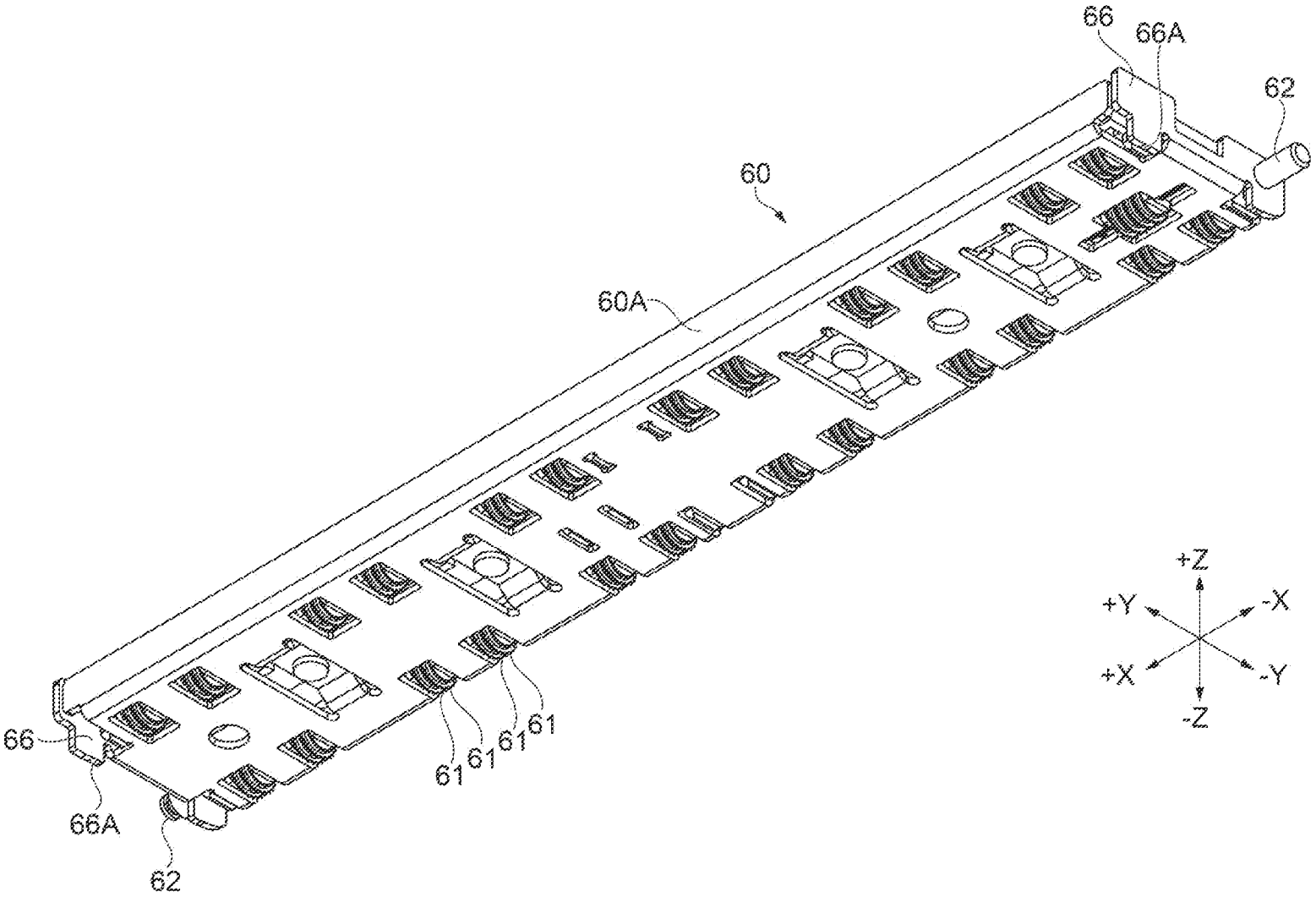
FIG. 4 is a perspective view illustrating a configuration of a star wheel unit according to the first exemplary embodiment.

As illustrated in FIGS. 3 and 4, the star wheel unit 60 includes a plurality of star wheels 61. A protrusion 61A (see FIG. 5) is formed on an outer peripheral edge of the star wheel 61 at a fixed angle pitch. The star wheel 61 is disposed at an interval in the width direction. The star wheel 61 is configured to be able to hold the continuous sheet S toward the non-suction surface 53 in a direction perpendicular to the non-suction surface 53. A portion of the protrusion 61A of the star wheel 61 is in contact with the continuous sheet S while the star wheel 61 is driven by rotation with respect to the transported continuous sheet S. Thus, a contact area with respect to the continuous sheet S is small, and the continuous sheet S can be transported while deterioration of quality of an image recorded on the continuous sheet S is reduced.

A shaft portion 62 protruding in the width direction is provided on each of an end portion in the +X direction and an end portion in the −X direction of the star wheel unit 60. Further, internal frames 63R and 63L that partition each of the side frames 24L and 24R and each of the ink cartridge mounting portions 29L and 29R are provided, and each of the shaft portions 62 of the star wheel unit 60 is supported by each of the internal frames 63R and 63L.

Figure 5:
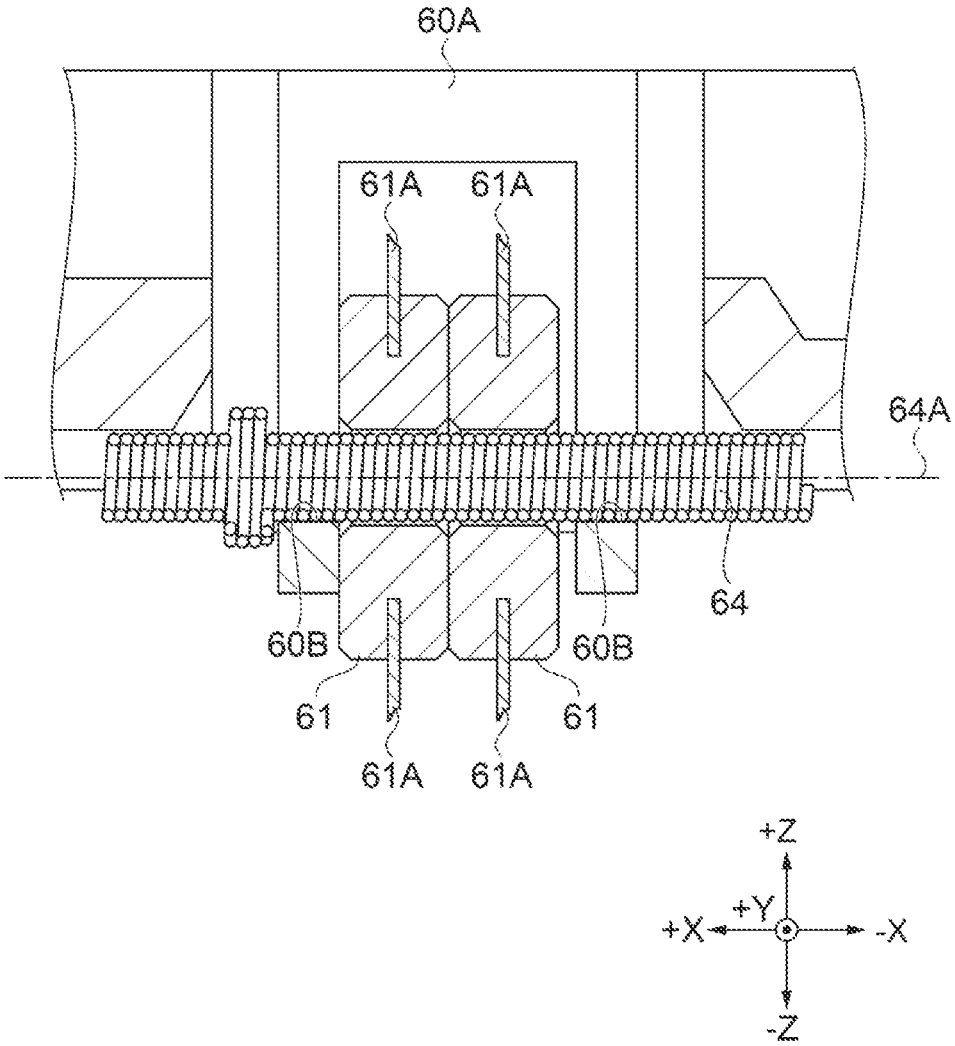
FIG. 5 is a partial cross-sectional view of the star wheel unit according to the first exemplary embodiment.

As illustrated in FIG. 5, the star wheel 61 is rotatably supported by a frame 60A of the star wheel unit 60.

Specifically, the star wheel 61 rotates about a spring shaft 64 (a shaft center 64A) formed of a compression spring as a rotary shaft. The spring shaft 64 is supported by an opening 60B provided in the frame 60A. In this way, for example, when the star wheel 61 holds the continuous sheet S, the star wheel 61 applies pressure to the continuous sheet S downward while the spring shaft 64 is deformed in a protruding shape in the +Z direction.

Here, in the example in FIG. 5, two star wheels 61 are configured to be supported by the spring shaft 64 in a state where the two star wheels 61 are fixed to each other, but the present disclosure is not limited thereto. One star wheel 61 may be configured to be supported by the spring shaft 64, or three or more star wheels 61 may be configured to be supported by the spring shaft 64. The spring shaft 64 has a fixed spring constant.

Note that a definition of a load of one star wheel 61 for holding the continuous sheet S will be described later.

As illustrated in FIG. 2, a cutter unit (not illustrated) for cutting the continuous sheet S can be mounted downstream of the suction platen 51 in the transport direction. The cutter unit may cut the continuous sheet S with a part of the continuous sheet S left in the width direction, or may completely cut the continuous sheet S. The printing apparatus 10 can cut the continuous sheet S on which printing is performed by the inkjet head 25 by a predetermined length by the cutter unit, and can emit the continuous sheet S from the paper exit 13.

The transport path 21 on which the continuous sheet S is transported from the accommodation portion 20 toward the paper exit 13 is formed inside the case 11 along the guide unit 30, the paper feeding roller 40, the suction platen 51, and the paper exit 13.

A guide wall 65 is provided above a downstream side of the guide unit 30 in the transport direction. The guide wall 65 extends in the width direction, and is supported by the side frames 24L and 24R. The guide wall 65 extends from an upper side to a lower side, and is curved to the downstream side in the transport direction as the guide wall 65 goes to the lower side. A lower end portion of the guide wall 65 faces the upper surface plate 31A of the guide unit 30 on the downstream side in the transport direction. In the present exemplary embodiment, the continuous sheet S can be transported to the guide unit 30 along the guide wall 65, and the continuous sheet S along the guide wall 65 can be transported by the paper feeding roller 40. An upper transport path 65A extending from the upper side along the guide wall 65 is formed.

An optical sensor 71 is disposed between the guide wall 65 and the guide unit 30. The optical sensor 71 is located on the transport path 21 downstream of the upper transport path 65A.

The optical sensor 71 is a sensor that detects a label on the continuous sheet S, and is a so-called label detector. The optical sensor 71 is formed of a light-emitting unit 71A that emits detection light, and a light-receiving unit 71B that receives the detection light. The light-emitting unit 71A is disposed on the guide wall 65, and the light-receiving unit 71B is disposed on the guide unit 30 so as to face the light-emitting unit 71A. Note that the light-receiving unit 71B may be disposed on the guide wall 65, and the light-emitting unit 71A may be disposed on the guide unit 30. The optical sensor 71 outputs a detection value according to the amount of light received by the light-receiving unit 71B. The printing apparatus 10 determines presence or absence of a label sheet in a position of the optical sensor 71, based on the detection value of the optical sensor 71.

Next, the definition of a load of one star wheel 61 for holding the continuous sheet S will be described.

As described above, the star wheel unit 60 is disposed in order to suppress floating of the continuous sheet S on the non-suction surface 53.

Further, the continuous sheet S transported in the present exemplary embodiment has a winding crimp caused by being wound in the roll shape. Specifically, the continuous sheet S unwound from the roll paper 100 is curved upward in a protruding shape.

Note that, in the platen 50, the continuous sheet S is transported while the continuous sheet S is sucked by the suction platen 51, and thus a winding crimp of the continuous sheet S is corrected and floating from the support surface 50A is prevented.

On the other hand, the suction platen 51 on the downstream side in the transport direction is the non-suction surface 53. Thus, in the non-suction surface 53, floating from the support surface 50A (the non-suction surface 53) due to a winding crimp of the continuous sheet S occurs. When the continuous sheet S is transported in a state where floating occurs, a jam easily occurs in the transport path 21. Thus, the star wheel 61 is disposed above the non-suction surface 53, and the continuous sheet S is held by the star wheel 61, and thus floating of the continuous sheet S can be suppressed.

However, depending on a holding state of a label sheet (the continuous sheet S) by the star wheel 61, for example, when a holding load on the label sheet by the star wheel 61 increases, there is a risk that image quality decreases due to a trace of the protrusion 61A of the star wheel 61 remaining on the label sheet, and a transfer, to another place of the label sheet, of an adhesive or ink of the label sheet adhering to a tip of the protrusion 61A of the star wheel 61.

Thus, in the printing apparatus 10 according to the present exemplary embodiment, a holding load of the star wheel 61 on the continuous sheet S is defined.

Figure 6:
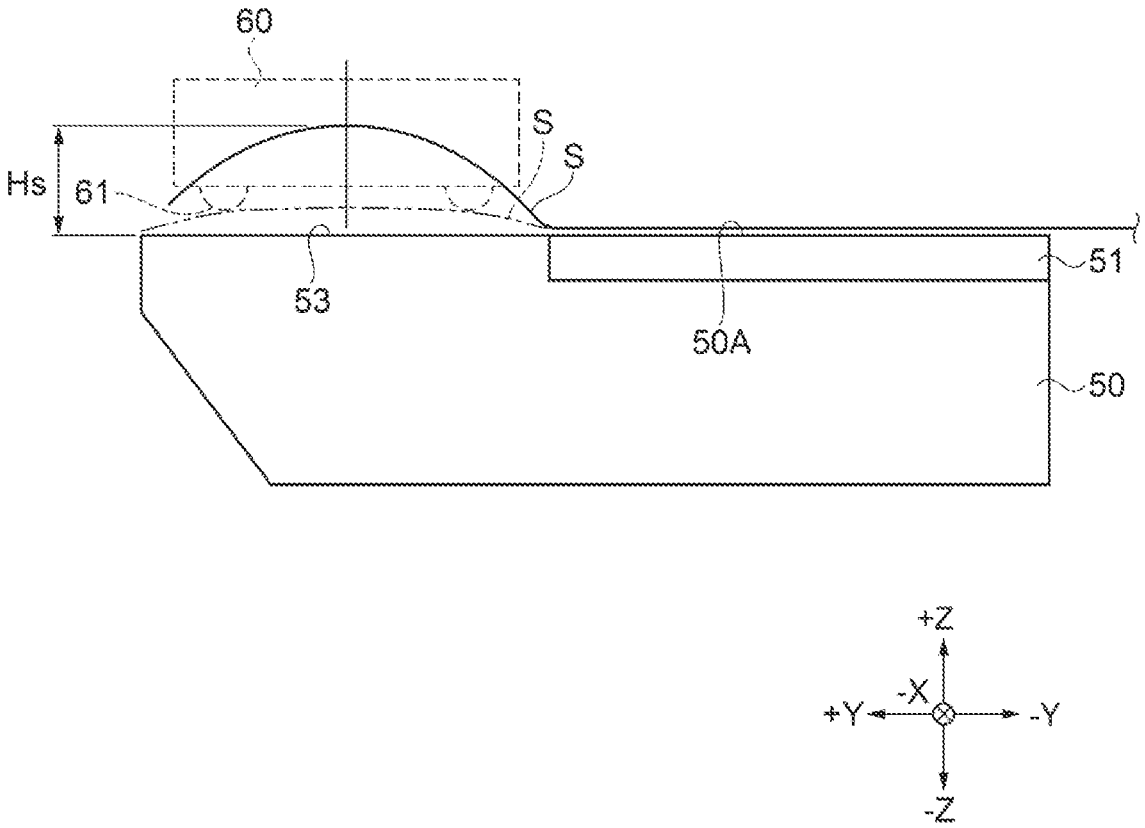
FIG. 6 is a schematic view illustrating a transport state of a continuous sheet according to the first exemplary embodiment.

Specifically, as indicated by a solid line in FIG. 6, in a case in which a maximum value Hs of a height of the continuous sheet S from the support surface 50A in a direction perpendicular to the support surface 50A is less than 2.2 mm when the continuous sheet S passes between the support surface 50A (the non-suction surface 53) and the star wheel unit 60, a load of one star wheel 61 for holding the continuous sheet S is defined to be equal to or less than 4.5 gf. Note that the maximum value herein is a maximum value of a height of the continuous sheet S from the support surface 50A in the direction perpendicular to the support surface 50A and a height of the continuous sheet S from the support surface 50A provided that the star wheel unit 60 is absent. In other words, in the printing apparatus 10 according to the present exemplary embodiment, in a case in which the maximum value Hs of the height of the continuous sheet S from the support surface 50A in the direction perpendicular to the support surface 50A is greater than 2.2 mm when the continuous sheet S passes between the support surface 50A (the non-suction surface 53) and the star wheel unit 60, a load of one star wheel 61 for holding the continuous sheet S is greater than 4.5 gf.

Then, as indicated by a double-dashed line in FIG. 6, the continuous sheet S is held with a load of the star wheel unit 60 equal to or less than the defined load, and thus floating of the continuous sheet S on the non-suction surface 53 is suppressed.

Figure 7:
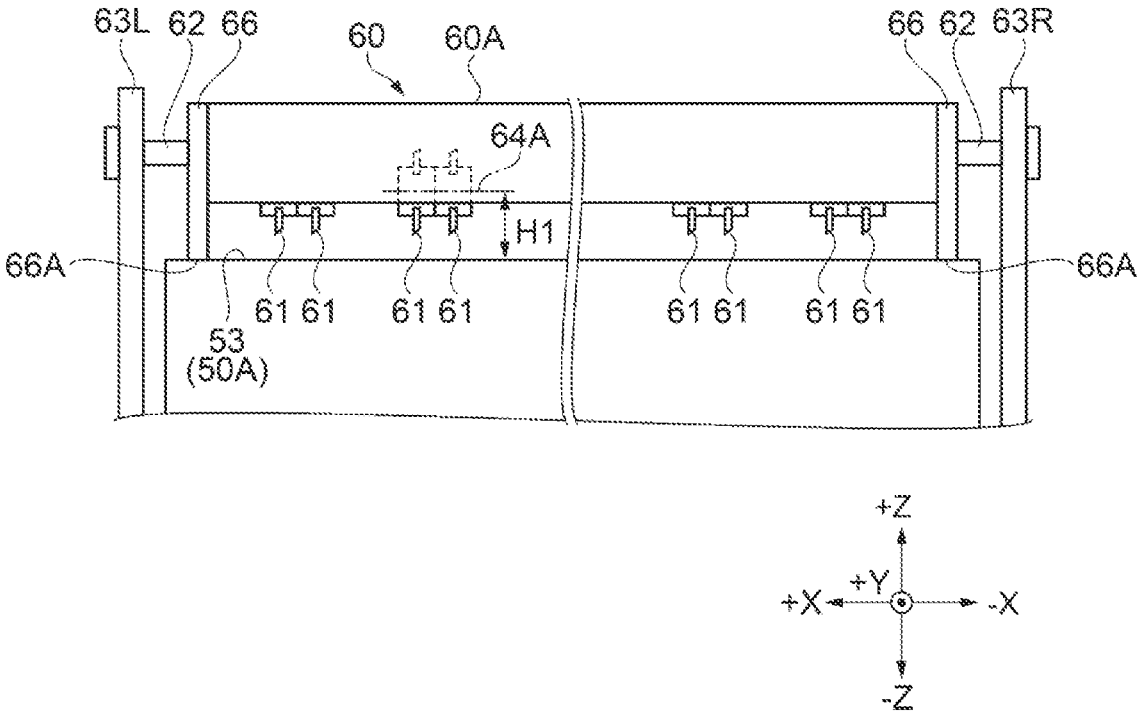
FIG. 7 is a front view illustrating the configuration of the star wheel unit according to the first exemplary embodiment.

As illustrated in FIG. 7, a regulating portion 66 that has a plate shape and regulates a height of the star wheel unit 60 is provided on each of the end portion in the +X direction and the end portion in the −X direction of the star wheel unit 60. Specifically, the regulating portion 66 includes a portion protruding farther than an end portion in a −Z direction of the frame 60A of the star wheel unit 60. A flat regulating surface 66A is provided on an end portion in the −Z direction of the regulating portion 66. Then, the regulating surface 66A and the support surface 50A (the non-suction surface 53) abut each other to define a height H1 between the support surface 50A (the non-suction surface 53) and the shaft center 64A of the star wheel 61 of the star wheel unit 60. The height H1 is a dimension in a state where there is no load on the star wheel 61. By defining the height H1, a defined load (equal to or less than 4.5 gf) of one star wheel 61 for holding the continuous sheet S can be satisfied.

Note that, in the present exemplary embodiment, a clearance between the end portion in the −Z direction of the star wheel 61 and the non-suction surface 53 (a gap between the suction platen 51 and the star wheel 61) is set to approximately 0.6 mm in a state where there is no load on the star wheel 61. Therefore, for example, when the maximum value Hs of the height of the transported continuous sheet S from the support surface 50A in the direction perpendicular to the support surface 50A is less than 0.6 mm, that is, when the star wheel 61 and the continuous sheet S are not in contact with each other, a load of one star wheel 61 for holding the continuous sheet S may be 0 gf.

2. Example

Next, an example will be described.

2-1. Examples 1 to 4 and Comparative Examples 1 to 4

A transported label sheet on which printing was performed was held by the star wheel unit 60 (the star wheel 61) by using the printing apparatus 10.

A load of one star wheel 61 applied to the label sheet was as illustrated in Table 1.

The transported label sheet on which printing was performed was wound around a core tube having a diameter φ of 3 inches.

2-2. Evaluation Content

The following image quality evaluation and trace evaluation were performed.

2-3 Image Quality Evaluation

Black solid printing was performed on the label sheet, and presence or absence of a defect (a white void) of an image due to a foreign material (adhesive and ink) that adheres to the tip of the protrusion 61A of the star wheel 61 was evaluated. The presence or absence of a defect of an image was visually determined.

2-3-1. Evaluation Criterion

A: absence of a defect

B: presence of a small amount of a defect

C: presence of a large amount of a defect 2-4. Trace Evaluation

A size of a trace of the protrusion 61A of the star wheel 61 formed on a surface of the label sheet after the label sheet was transported was measured.

2-4-1. Evaluation Criterion

A: size of one trace less than 3000 $\mu m^2$.

B: size of one trace equal to or greater than 3000 $\mu m^2$

A result was as illustrated in Table 1.

TABLE 1

| | LOAD (gf) | IMAGE QUALITY EVALUATION | TRACE EVALUATION |
|---|---|---|---|
| EXAMPLE 1 | 2.0 | A | A |
| EXAMPLE 2 | 2.5 | A | A |
| EXAMPLE 3 | 4.0 | A | A |
| EXAMPLE 4 | 4.5 | A | A |
| COMPARATIVE EXAMPLE 1 | 5.0 | B | B |
| COMPARATIVE EXAMPLE 2 | 6.0 | B | B |
| COMPARATIVE EXAMPLE 3 | 8.0 | B | B |
| COMPARATIVE EXAMPLE 4 | 9.0 | C | B |

As illustrated in Table 1, when a load of one star wheel 61 applied to the label sheet was equal to or less than 4.5 gf (Examples 1 to 4), an excellent result was obtained in the image quality evaluation and the trace evaluation. On the other hand, when a load of one star wheel 61 applied to the label sheet was greater than 4.5 gf (Comparative Examples 1 to 4), it was clear that all evaluations were inferior to those of Examples 1 to 4.

As described above, according to the present exemplary embodiment, even when the continuous sheet S having a winding crimp caused by being wound around the core tube is used as the continuous sheet S, a load of one star wheel 61 fort holding the continuous sheet S is adjusted. Thus, for example, when the continuous sheet S is a label sheet, adhesion of an adhesive and ink to the tip of the protrusion 61A of the star wheel 61, and an occurrence of a trace by the protrusion 61A of the star wheel 61 on the continuous sheet S can be suppressed, and the image quality can be improved.

3. Second Exemplary Embodiment

Next, a second exemplary embodiment will be described. Specifically, a configuration of a printing apparatus 10A and a method for controlling the printing apparatus 10A will be described. More specifically, a hoisting and lowering mechanism of a star wheel unit 600 and a method for controlling the star wheel unit 600 will be described. Note that a configuration other than the hoisting and lowering mechanism of the star wheel unit 600 is similar to that in the first exemplary embodiment, and the same configuration as that in the first exemplary embodiment is provided with the same reference sign, and redundant description is omitted.

Figure 8:
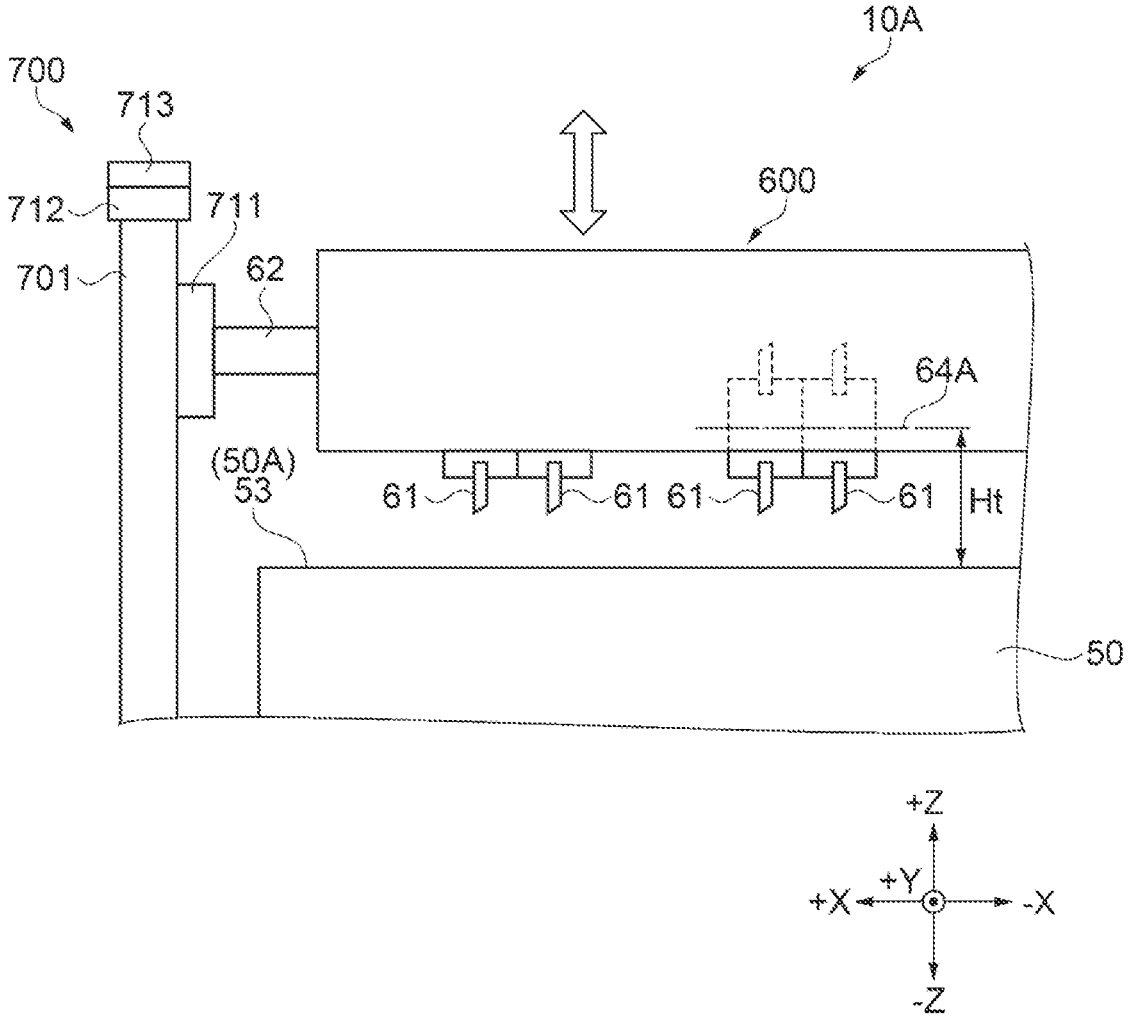
FIG. 8 is a schematic view illustrating a configuration of a printing apparatus according to a second exemplary embodiment.
Figure 9:
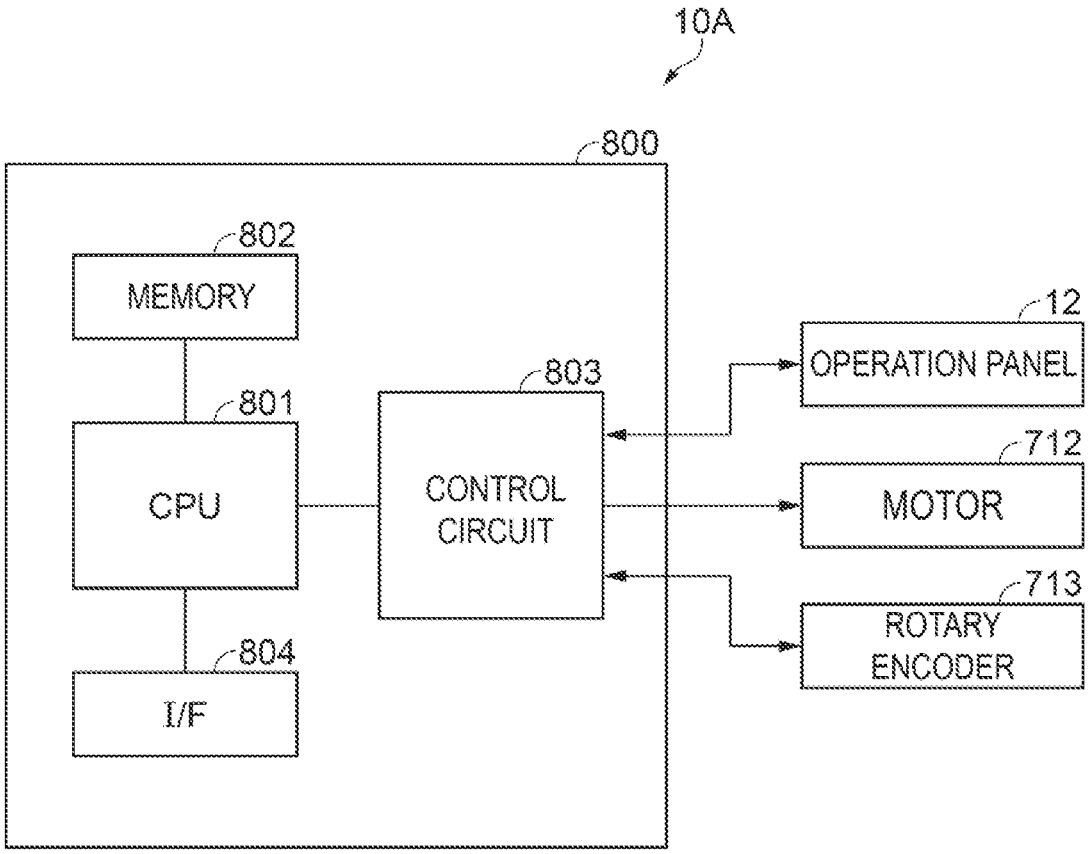
FIG. 9 is a block diagram illustrating a control configuration of the printing apparatus according to the second exemplary embodiment.

FIG. 8 is a schematic view illustrating the configuration of the printing apparatus 10A according to the present exemplary embodiment, and particularly, a schematic view illustrating a configuration around the star wheel unit 600. FIG. 9 is a block diagram illustrating a control configuration of the printing apparatus 10A, and specifically, a block diagram illustrating a configuration of hoisting and lowering control of the star wheel unit 600.

As illustrated in FIG. 8, the printing apparatus 10A includes a hoisting and lowering unit 700 that can hoist and lower the star wheel unit 600 with respect to a support surface 50A (a non-suction surface 53).

The hoisting and lowering unit 700 includes a ball screw shaft 701 provided upright in a direction along the Z-axis, a ball nut 711 that engages with the ball screw shaft 701, a guide portion (not illustrated) that guides the ball nut 711 in a movement direction, and the like. A motor 712 is coupled to the ball screw shaft 701. As the motor 712, various motors such as a stepping motor, a servo motor, and a linear motor may be adopted. The ball nut 711 can be hoisted and lowered in the direction along the Z-axis by driving the motor 712.

A shaft portion 62 of the star wheel unit 600 is fixed to the ball nut 711. In this way, the star wheel unit 600 can be hoisted and lowered.

Further, the hoisting and lowering unit 700 includes a rotary encoder 713 that detects a rotational direction and a rotational amount of the motor 712 or the ball screw shaft 701. In this way, a displacement (a position) of the star wheel unit 600 can be detected. In the present exemplary embodiment, a height Ht between the support surface 50A (the non-suction surface 53) and a shaft center 64A of a star wheel 61 can be detected.

Note that the hoisting and lowering mechanism of the star wheel unit 600 is not limited to the configuration described above, and may have a configuration using a cam or a solenoid.

Further, the printing apparatus 10A includes a designation unit that designates a permissible value of a height of a continuous sheet S from the support surface 50A in a direction perpendicular to the support surface 50A when the continuous sheet S passes between the support surface 50A and the star wheel unit 600. Note that the permissible value herein is a permissible value of a height of the continuous sheet S from the support surface 50A in the direction perpendicular to the support surface 50A, and a height of the continuous sheet S from the support surface 50A provided that the star wheel unit 600 is absent.

In the printing apparatus 10A, a plurality of types of continuous sheets S can be applied. Here, a height from the support surface 50A in the direction perpendicular to the support surface 50A may vary depending on each of the continuous sheets S. For example, since a continuous sheet S wound around a core tube having a diameter φ of 3 inches and a continuous sheet S wound around a core tube having a diameter φ of 6 inches have different forms of a winding crimp of each of the continuous sheets S, a height from the support surface 50A in the direction perpendicular to the support surface 50A varies. In this case, the continuous sheet S wound around the core tube having the diameter φ of 3 inches has a stronger winding crimp, and a height from the support surface 50A is greater.

Thus, the designation unit designates a permissible value for each of the continuous sheets S. For example, the designation unit may be configured to designate a permissible value of a height by an operation panel 12, or may have a configuration in which a permissible value of a height is designated in a control unit 800 based on input information about the continuous sheet S from the operation panel 12 or an information processing terminal.

Note that a permissible value for the continuous sheet S may be designated in consideration of a parameter such as a diameter size of the core tube, a material or a thickness of the continuous sheet S instead of a winding crimp.

As illustrated in FIG. 9, the control unit 800 includes a CPU 801, a memory 802, a control circuit 803, and an interface (I/F) 804. The CPU 801 is an arithmetic processing device. The memory 802 is a storage device that secures a region for storing a program of the CPU 801, a working region, or the like, and includes a storage element such as a RAM and an EEPROM. When print data and the like are acquired from the outside of the information processing terminal and the like via the I/F 804, the CPU 801 controls each driving portion (the motor 712) and the like.

Table data in which a permissible value for each of the continuous sheets S and a height position in which a load of one star wheel 61 for holding the continuous sheet S is equal to or less than 4.5 gf are associated with each other is stored in the memory 802.

In a case in which the control unit 800 determines that a height of the continuous sheet S from the support surface 50A in the direction perpendicular to the support surface 50A is equal to or less than a permissible value when the continuous sheet S passes between the support surface 50A (the non-suction surface 53) and the star wheel unit 600, the control unit 800 drives the motor 712 and controls a movement of the hoisting and lowering unit 700 to a defined position such that a load of one star wheel 61 for holding the continuous sheet S is equal to or less than 4.5 gf.

Note that, when the control unit 800 determines that a height of the continuous sheet S from the support surface 50A in the direction perpendicular to the support surface 50A is greater than a permissible value, the control unit 800 stops transport driving of the continuous sheet S.

According to the present exemplary embodiment, by moving the star wheel unit 60 in an up-and-down direction according to a permissible value for a height of the continuous sheet S from the support surface 50A due to a winding crimp, the continuous sheet S can be held with an appropriate load.

What is claimed is:

1. A printing apparatus, comprising:

a printing head configured to discharge ink onto a recording medium to form an image;

a platen including a support surface that supports the recording medium; and a recording medium holding portion located at a position that is downstream of the printing head in a transport direction of the recording medium and faces the support surface, the recording medium holding portion being configured to hold a plurality of star wheels configured to hold the recording medium toward the support surface in a direction perpendicular to the support surface, wherein, in a case in which a maximum value of a height of the recording medium from the support surface in the direction perpendicular to the support surface is less than 2.2 mm when the recording medium passes between the support surface and the recording medium holding portion, a load of one of the star wheels for holding the recording medium is equal to or less than 4.5 gf, where the maximum value is a maximum value of a height of the recording medium from the support surface in the direction perpendicular to the support surface, the height being a height of the recording medium from the support surface provided that the recording medium holding portion is absent.

2. The printing apparatus according to claim 1, comprising:

a hoisting and lowering unit configured to hoist and lower the recording medium holding portion with respect to the support surface;

a designation unit configured to designate a permissible value of a height of the recording medium from the support surface in the direction perpendicular to the support surface provided that the recording medium holding portion is absent when the recording medium passes between the support surface and the recording medium holding portion; and a control unit, wherein the control unit controls the hoisting and lowering unit such that a force of one of the star wheels for holding the recording medium becomes equal to or less than 4.5 gf in a case in which a height of the recording medium from the support surface in the direction perpendicular to the support surface is equal to or less than the permissible value when the recording medium passes between the support surface and the recording medium holding portion where the permissible value is a permissible value of a height of the recording medium from the support surface in the direction perpendicular to the support surface, the height being a height of the recording medium from the support surface provided that the recording medium holding portion is absent.

* * * * *